US005628668A

United States Patent [19]

Takemae

[11] Patent Number: 5,628,668

[45] Date of Patent: May 13, 1997

[54] WALKING DOLL

[75] Inventor: Kunitaka Takemae, Tokyo, Japan

[73] Assignee: Seikoken Kabushiki Kaisha, Tokyo, Japan

[21] Appl. No.: 492,485

[22] Filed: Jun. 20, 1995

[30] Foreign Application Priority Data

Jun. 22, 1994 [JP] Japan ..... 6-163223

[51] Int. Cl.[6] ..... A63H 7/00; A63H 13/00

[52] U.S. Cl. ..... 446/355; 446/351; 446/326; 446/377

[58] Field of Search ..... 446/355, 354, 446/353, 352, 351, 336, 333, 330, 325, 326, 376, 377, 381, 382, 383, 390

[56] References Cited

U.S. PATENT DOCUMENTS

| | | | |
|---|---|---|---|
| 950,536 | 3/1910 | Killman | 446/352 X |
| 1,687,675 | 10/1928 | Lehman | 446/355 |
| 1,800,874 | 4/1931 | Savage | 446/355 |
| 2,269,334 | 1/1942 | Bocchino | 446/355 X |
| 3,599,364 | 8/1971 | Garcia | 446/355 |
| 3,862,513 | 1/1975 | Isaacson et al. | 446/390 X |
| 3,940,879 | 3/1976 | Glass et al. . | |
| 4,795,395 | 1/1989 | Oishi et al. | 446/355 X |
| 4,802,878 | 2/1989 | Terzian et al. | 446/352 X |
| 5,176,560 | 1/1993 | Wetherell et al. | 446/354 X |

FOREIGN PATENT DOCUMENTS

| | | | |
|---|---|---|---|
| 501931 | 2/1920 | France | 446/354 |
| 271101 | 1/1930 | Italy | 446/333 |
| 1256991 | 8/1968 | Japan . | |
| 1076943 | 7/1967 | United Kingdom . | |
| 2045625 | 11/1980 | United Kingdom | 446/355 |
| 2047551 | 12/1980 | United Kingdom | 446/355 |

*Primary Examiner*—Michael A. Brown
*Assistant Examiner*—D. Neal Muir
*Attorney, Agent, or Firm*—Notaro & Michalos PC

[57] ABSTRACT

Complicated movements of a walking doll such as going frontward or backward while making a big turn or making a turn in place is possible if the walking doll includes a body with a gear unit for supporting and driving a pair of feet having the same length and moved in an oscillating manner in the front/rear direction with respect to the body without restraint. The doll stands erect on the feet since they have surfaces which stay in contact with the floor. These surfaces have a curvature in the oscillating direction and the curvature is constantly in contact with the floor. A member for adjusting the position of a gravitational center of the doll is swiveled or deformed on a first plane parallel to the oscillation direction and another plane orthogonal to the first plane. This can three-dimensionally shift the center of gravity frontward or backward or to a side region of the doll.

20 Claims, 13 Drawing Sheets

WALKING DOLL

FIELD AND BACKGROUND OF THE INVENTION

The present invention relates to a doll which walks or stamps its feet so as to shuffle along, without lifting its feet from the floor. In the present specification, a plane on which the doll walks is generically called a floor. More particularly, the present invention relates to a walking doll which is capable of shuffling its feet or making a turn in an arbitrary direction as it walks.

A walking doll of the prior art alternately lifts its feet from the floor and repeatedly stands on one foot as it walks. For this purpose, it is necessary to make each foot of large size in such a way that the doll can stand on one foot. The prior art doll is therefore apt to loose its balance and fall down as the walking speed is increased. Its movement is also linear and devoid of interest.

The inventor of the present application has proposed a doll which can alternately move its feet back and forth in a shuffling motion, without lifting its feet from the floor as it rapidly walks. See Japanese Patent Application Laid-open No. Sho 63-86375 and Japanese Patent Laid-open No. Hei 1-256991. As to this doll, which is shown in FIGS. 10A and 10B, two feet 102, 103, each having the same length are connected to a body 101 in such a manner that the feet can freely oscillate back and forth on a shaft 104 at the center of the oscillation. The feet 102 and 103 and the shaft 104 are connected by means of a crank 106 and a slotted hole 107 of a spring-driven gear unit 105. A pin 108 of the crank 106 which rotates by the force of the spring is fitted into the slotted hole 107, thus compelling the feet 102 and 103 to alternately oscillate back and forth. Accordingly, the doll does not walk by completely lifting soles 102*a* and 103*a* from the floor 109, but rather, both feet 102 and 103 alternately move back and forth, like shuffling, with the soles 102*a* and 103*a* being lightly brought into contact with the floor 109 as the doll walks. In the case of this doll, since the direction of progress varies due to an insignificant change in the frictional resistance between feet 102, 103 and the floor 109, the direction of walking becomes unstable, whereby the doll moves irregularly.

It may, however, be necessary to impart a direction to the movement of the doll, depending on the situation. As a countermeasure, co-axial rotary shafts 111 each piercing through the side face of the body 101 and wings 110 each of which can rotate backward and forward around the single axis rotary shaft 111 are fixed to the body 101, thereby shifting the center of gravity of the whole doll forward or backward by the rotation of the wings 110. With such a configuration, the doll can shuffle its feet forward or backward as it walks. For example, when the wings 110 are rotated forward to shift the center of gravity of the doll forward, the doll shuffles its feet forward in the forward-bent posture. Further, when the wings 110 are rotated backward to shift the center of gravity of the doll backward, the doll shuffles its feet backward in the backward-bent posture like stepping back.

With such an arrangement, the movement direction of the doll is restricted to three types, i.e., forward movement, backward movement and a halting of its progress while it marches in place. The movement of the doll is thus uninteresting.

SUMMARY OF THE INVENTION

It is therefore an object of the present invention to provide a walking doll which is capable of going straight forward and backward or making a big turn while stepping forward or backward, or which is capable of making a complicated movement such as making a turn in place.

To achieve this aim, the present invention provides a walking doll which includes, in a body, a power crank mechanism for supporting a pair of feet each having the same length, and for oscillating the feet in the front or rear direction with respect to said body, without restraint, and for alternately oscillating the feet back and forth by force. The doll stands erect on the feet since a surface of each foot which is in contact with the floor, is formed to have a curvature in the oscillating direction. The feet are thus constantly in contact with the floor. The walking doll is characterized by having a member for adjusting the position of its gravitational center. The member is swiveled or deformed in a first plane that is parallel to the forcible oscillating direction and in another plane as well, which is orthogonal to the first plane. The member is thus capable of a three-dimensionally shifting of the position of gravitational center, back and forth or transversely of the doll.

Further, in a walking doll according to the present invention, the member for adjusting the position of gravitational center is three-dimensionally fixable at either or both of the front and rear regions or side regions of the body. The member can be repositioned without restraint by means of a first rotary shaft substantially orthogonal to the forcible oscillation direction of the feet, and a second rotary shaft that is orthogonal to the first rotary shaft, or by means of a spherical joint. Depending on the case, however, the member for adjusting the position of gravitational center may be freely attached to or removed from the body.

In addition, the member for adjusting the position of gravitational center may consist of a material which can be arbitrarily plastically deformed, and the center of gravity can be moved toward front and rear regions or side region of the body by deforming the member for adjusting the gravitational center in this way.

Moreover, the member for adjusting the position of gravitational center is provided with a weight at the tip or end thereof, and more preferably the member is formed into an L shape. It is enough to provide one member for adjusting the position of gravitational center to a side portion of the body, but two members may be provided, one on each side of the body and symmetrically.

The walking doll according to the present invention is preferably provided with a weight in the vicinity of portions of the feet which are brought into contact with the floor.

The walking doll can also stand on a parietal portion of its body and the tip of the member for adjusting the position of gravitational center, and rotate with the parietal portion in the center, like break dancing.

Further, the walking doll according to the present invention can support a ball at a tip of one of its feet, in such a manner that the ball can move back and forth in order to mimic the movement like dribbling a ball, when walking.

In addition, when the walking doll according to the present invention is provided with a silk hat which is part of the member for adjusting the position of gravitational center having a weight in the tip thereof, the doll with the silk hat can move its feet back and forth in place like tap dancing, besides the walking movement.

Accordingly, when the feet alternately oscillate back and forth by force with the rotation of the power crank mechanism, the doll shuffles its feet from the position where each foot is in contact with the floor toward the position of the center of gravity without lifting the feet from the floor.

For example, when the center of gravity of the doll is positioned over the middle of the feet, the doll halts, and stamps its feet in place and does not move forward or backward. Further, when the center of gravity is positioned at the side region of the body, away from the feet, the doll makes a small turn in place. Moreover, when the member for adjusting the position of gravitational center is shifted toward the front region of the doll, the doll takes a slightly-forward-bent posture and alternately moves the feet, thus shuffling the feet as it walks. At this time, the shift of the center of gravity toward the front region of the doll by the member for adjusting the position of gravitational center causes forward movement of the doll. Further, when the center of gravity is positioned to one side of the front region of the doll, the doll makes a large turn toward the center of gravity. Furthermore, the shift of the member for adjusting the position of gravitational center toward the rear region of the doll leads to the slightly-backward-bent posture of the doll. The doll then walks backward while shuffling its feet. At this time, when the center of gravity is positioned right behind the doll, the doll walks, stepping back in a straight line. In addition, when the center of gravity is positioned to one side of the rear region, the doll walks backward while making a large turn toward the center of gravity.

Particularly, when the present invention uses a weight at the tip of the member for adjusting the position of gravitational center, the vector toward the center of gravity becomes large, and the walking speed of the doll is increased and the doll securely makes progress toward an intended direction.

In addition, if the tip of the member for adjusting the gravitational center is positioned in the front or rear region of the body, and the center of gravity is placed at a position close to the center plane of the body, this enables straight progress of the doll. Moreover, in the case of the invention according to when a weight is provided in the vicinity of the toes of the feet which are portions to be brought into contact with the floor, the center of gravity is positioned low, resulting in stable walking movement.

DESCRIPTION OF THE PREFERRED EMBODIMENTS

Figure 1:
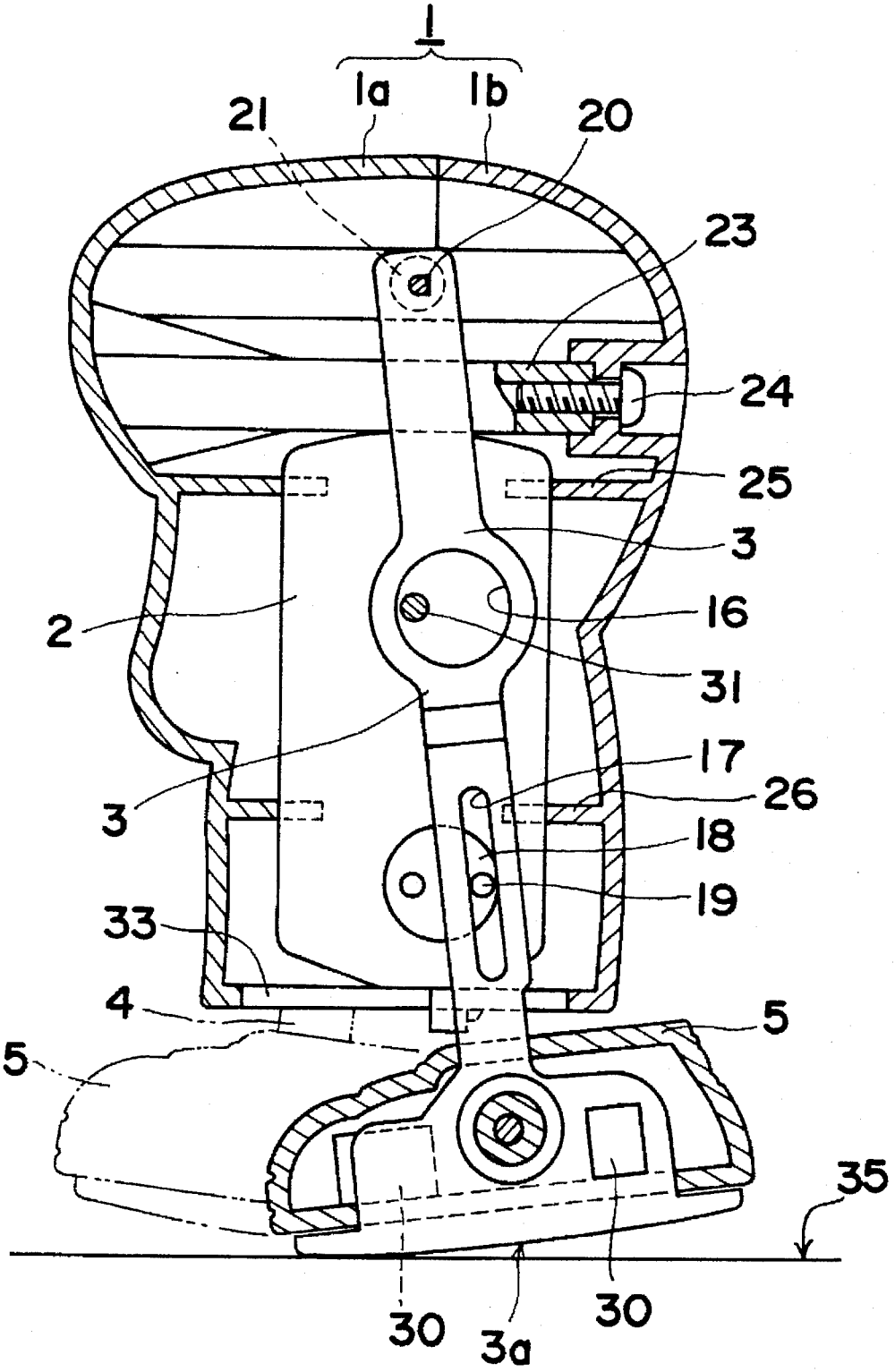
FIG. 1 is a vertical sectional view showing an embodiment of a walking doll according to the present invention, in which the doll is modeled as a basketball player.

The configuration of the present invention will be explained hereunder in detail in connection with illustrated embodiments.

An embodiment of the present invention is shown in FIGS. 1 to 5. This embodiment is a doll using a basketball player as a model, and it can move forward or backward in various directions or stamp its feet in place or make a turn with a ball in hand. This doll is constituted by: a body 1 containing a gear unit 2 using a spring as a driving source; a pair of feet 3 and 4 which have the same length and are connected in the body 1 so as to oscillate without restraint; and a member 34 for adjusting the position of gravitational center which adjusts the position of the center of gravity of the doll.

As to the body 1, the uniform, the face, the trunk and one arm of the basketball player, these are molded or printed and, for example, these are formed by a plastic injection-molded product. The body 1 is constituted by two pieces 1*a* and 1*b* split along a transverse plane in the front and rear directions, and the pieces 1*a* and 1*b* are fitted together so as to contain the gear unit 2 and the feet 3 and 4 in the body 1. These pieces 1*a* and 1*b* are united by means of a screw 24 or the like. The screw 24 is screwed in a stanchion 23 protruding from one piece 1*a* through a hole of a concave portion of the other piece 1*b* to connect both pieces 1*a* and 1*b* together. The pieces 1*a* and 1*b* are connected at the lower portion of the body by fitting a claw 28 in a hole 27. The pair of feet 3 and 4 are attached to the body 1 by a pin or shaft 20 in such a manner that the feet 3 and 4 can oscillate without restraint at the upper portion of the body 1. In this embodiment, the pin 20 is supported in a rotatable manner so as to be sandwiched between two semicircular concave portions 21 formed on the surfaces of the pieces 1*a* and 1*b* which are in contact with each other. Sleeves 22 are integrally formed at the portion where the pin 20 of the feet 3 and 4 pierces so as to prevent the feet 3 and 4 from jolting in the horizontal direction.

The gear unit 2 having a spring as a driving source is set in the center of the body 1. The gear unit 2 has two cranks 18 at both ends of the output shaft thereof, and is of a well-known general type as a power source of a walking doll. In this gear unit 2, speed up gears or a constant speed mechanism may be interposed between a shaft 31 having a spring wound therearound and the output shaft provided with the two cranks 18 if necessary. The shaft 31 is rotated in the opposite direction by the force of the spring wound by the rotation of a lug 32 provided at the tip of the shaft 31 to further rotate the two cranks 18. The cranks 18 provided at both ends of the output shaft of the gear unit 2 have crank pins 19 and 19 which are positioned at intervals of 180° and fitted in two slotted holes 17 of the feet 3 and 4 arranged along the gear unit 2. Therefore, the feet 3 and 4 alternately oscillate back and forth by force with the rotation of the output shaft. The gear unit 2 is supported and fastened by two U-shaped holding plates 25 and 26 which are integrally formed in the body 1.

As for the feet 3 and 4 which are attached to the body 1 in such a manner that the feet 3 and 4 can oscillate without restraint, the surfaces 3*a* and 4*a* (these are referred to as soles hereinafter) to be in contact with the floor are formed to have a curvature in the forcible oscillating direction or the front/rear direction of the body, and therefore the feet 3 and 4 are constantly in contact with the floor 35 and the doll can stand erect on its feet. In this embodiment, each of the plate like soles 3*a* and 4*a* has a lower edge with a curved surface having a radius of curvature at the center of shaft 20.

The present invention however is not restricted to this configuration, and any curved surface having a larger or smaller radius of curvature can be embodied as long as it is not a planar surface. The portion of each foot 3 or 4 which intersects the spring shaft 31 of the gear unit 2 is formed into a ring shape, and the spring shaft 31 is inserted through a center hole 16 of the ring-shaped portion. With such a structure, the feet 3 and 4 do not collide with the spring shaft 31 even when the feet 3 and 4 oscillate back and forth. Further, the slotted hole 17 is formed in the longitudinal direction at another portion of each foot 3 or 4 which intersects each crank pin 19 of the crank 18, and each crank pin 19 is fitted in the slotted hole 17 in the front and rear directions of the doll. Accordingly, when the two cranks 18 rotate, the two crank pins 19 move in the slotted holes 17 of the feet 3 and 4 in the longitudinal direction while driving the feet 3 and 4 backward and forward. A pair of shoes 5, designed as basketball shoes, are fixed to the feet 3 and 4 in the vicinity of the tips of the feet 3 and 4 which are brought into contact with the floor 35. The bottoms of the shoes 5 are positioned higher than the soles 3*a* and 4*a*, and so designed as not to be brought into contact with the floor 35 directly. Weights 30 are accommodated in the shoes 5 to give an impetus to the oscillation of the feet 3 and 4 and lower the position of the center of gravity, thereby maintaining stable walking movement. Each of the shoes 5 is formed by two split members 5*a* and 5*b*and these members 5*a* and 5*b* are so connected as to sandwich the weights 30 and the foot 3 or 4 therebetween. Since the feet 3 and 4 oscillate, two grooves 33 elongated in the front/rear direction of the doll are formed in the body 1, and the feet 3 and 4 are accommodated in the body 1 so as to pierce through the grooves 33.

In general, the material of the feet 3 and 4 may preferably be plastic having a good sliding property such as polyacetal or polytetrafluoroethylene, but the doll is apt to fall down when the sliding property is too high. According to a trial product of the present application, it was found that the use of polyacetal is suitable. Further, each of the soles 3*a* and 4*a* is formed into a vertical plate or ridge having a width narrower than the shoe 5. If the area to be in contact with the floor is large, it is not possible to move the doll unless the spring is fully wound, and hence the spring cannot be used effectively. Moreover, when the area to be in contact with the floor is large, the doll executes large movements and has a tendency to easily fall down.

The member 34 for adjusting the position of gravitational center is swiveled or deformed in a first plane substantially parallel with the forcible oscillating direction and in the transverse plane which is orthogonal to the first plane. With this member, it is possible to three-dimensionally move the position of gravitational center to the front/rear region or the side region of the body. Stated in another way, member 34 is movably connected to body 1 for repositioning with at least two orthogonal degrees of freedom. In this embodiment, the member for adjusting the position of gravitational center 34 is attached to the body 1 through a first rotary shaft 9 which is substantially orthogonal to the plane parallel with the forcible oscillating direction of the feet 3 and 4, and a second rotary shaft 11 orthogonal to the first rotary shaft 9. Member 34 consists of members having a mass which is capable of shifting the center of gravity of the doll. For example, the member for adjusting the position of gravitational center 34 is constituted by a member obtained by molding an arm 6 and a basketball 7 of the basketball player as one piece. The two shafts 9 and 11 for attaching this member to the body 1, allow member 34 to be repositioned without restraint in the front/rear direction of the doll 1 and in the transverse direction of the doll, orthogonal to the former direction. The first rotary shaft 9 for connecting the shoulder joint of the arm 6 and the shoulder portion of the body 1 is accommodated in a concave portion 15 formed on the contact surfaces of the two pieces 1*a* and 1*b* constituting the body 1 so as to be held by the concave portion 15 and is attached to the body 1 in a rotatable manner. A flange 14 for preventing the first rotary shaft 9 from coming off the body 1 is provided to the end portion of the first rotary shaft 9, and an O ring 10 is interposed between the flange 14 and the inner surface of the body 1. The O ring 10 avoids the unrestrained rotation of the first rotary shaft 9 and allows the first rotary shaft 9 to be slightly inclined and to stay in the position it is placed. As a result, it becomes possible to avoid breaking the arm 6 even when the arm 6 is rotated in an unnatural direction and prevent the arm 6 from being lowered due to the weight thereof after setting the arm 6 at a desired angle. Further, the second rotary shaft 11 is provided in the arm 6 so as to be orthogonal to the first rotary shaft 9. The second rotary shaft 11 is a cylindrical shaft formed on one of the two pieces constituting the arm 6 as one body. The first rotary shaft 9 is put on the second rotary shaft 11 and a pin 12 which is formed on the other piece as one piece is inserted in the second rotary shaft 11 to support the first rotary shaft 9. Thus, the arm 6 can oscillate with the two rotary shafts 9 and 11 which are orthogonal to each other in the center without restraint in the front/rear direction and the transverse direction orthogonal to the former direction.

In addition, the arm 6 constituting a part of the member for adjusting the position of gravitational center is curved like an L, extending from the portion to be attached to the body 1 to the ball 7 which is the end portion of the arm 6, and hence the area of movement of the arm 6 can be enlarged when rotating the arm 6 around the second rotary shaft Here, a notch 13 is provided at an intersection of the arm 6 and the first rotary shaft 9 to enable swiveling of the arm 6 around the first rotary shaft 9. Further, weights 8 are accommodated in the ball 7. The weights 8 are effective by giving a impetus to the movement caused by the shift of the gravitational center. However, when the center of gravity is shifted by the entire weight of the arm 6 including the ball 7 sufficiently, the weights 8 may not be necessary.

As the power source for forcibly oscillating the feet 3 and 4, there is adopted the gear unit 2, the mechanism with the spring which is wound and the crank shaft which is rotated by using this spring force, but the present invention is not restricted to this type of power source. For instance, it may be possible to use other power source such as an electric motor.

Since the present invention has the above-described configuration, the walking direction of the doll can be arbitrarily determined by rotating the arm 6 to change the position of the ball 7. For example, when the arm 6 is thrusted to the side region of the doll to take such a posture that the doll holds the ball 7 at its side (the posture shown in FIGS. 2 or 4), the doll makes a turn with the position of the ball in the center in place while shuffling its feet as it walks. Further, when the arms 6 is rotated to move the ball 7 to the front region of the body 1, the center of gravity is shifted nearly in front of the doll and then the doll walks substantially straight ahead. Moreover, when the arm is further moved outwardly to shift the ball 7 to the side region, the center of gravity is shifted diagonally to the front of the body 1, and hence the doll walks forward while making a big turn. In addition, when the arm 6 is rotated to the rear region to shift the ball 7 right behind the body 1, since the center of gravity is shifted to the nearly rear region of the doll, the doll walks like stepping back in a substantially straight line. Here, when the arm 6 is moved outwardly to shift the ball 7 to the side region of the doll, since the center of gravity is shifted diagonally to the rear of the body 1, the doll moves back while making a big turn.

Figure 7:
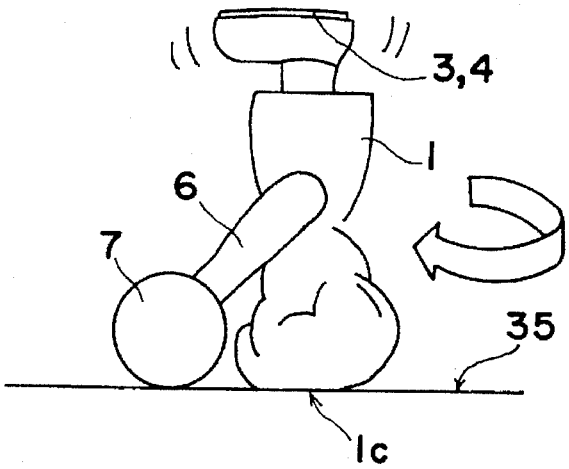
FIG. 7 is another embodiment of the walking doll according to the present invention and is an explanatory view illustrating the state in which the doll performs break dancing.

Although the above description has been given as to one preferred embodiment of the present invention, the invention is not restricted to this type and many additional modifications and variations are possible within the true scope of the present invention. For example, although the explanation about the head of the doll has not been given, when the body 1 is inverted to place a head 1*c* on the floor and the body 1 is supported between the arm 6 and ball 7 which are the members for adjusting the position of gravitational center, the doll supported by the head 1*c* and the ball 7 rotates like break dancing by the thrash and inertia of the feet 3 and 4, as shown in FIG. 7. Such a movement imparts the interest to the play which has not been found in the prior art walking dolls.

Figure 8:
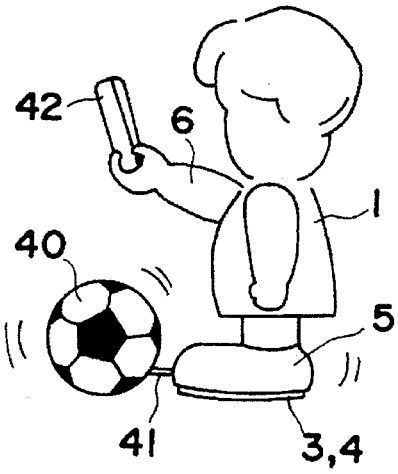
FIG. 8 is still another embodiment of the walking doll according to the present invention and is an explanatory view illustrating the state in which the doll kicks a soccer ball.

Further, as shown in FIG. 8, another member such as a soccer ball 40 is connected by means of a pin 41 to a shoe 5 provided at the end portion of a foot 3 or 4 in a freely movable manner. When the soccer ball 40 is so provided as to unrestrictedly move back and forth or transversely with the movement of the feet 3 and 4, it looks as if the doll walks kicking the ball 40. In this case, when the center of gravity is adjusted by providing a card type weight 42 corresponding to a penalty card such as a yellow card or a red card at the tip of the arm 6 of the doll, the interest of the doll's movement is increased.

Figure 9:
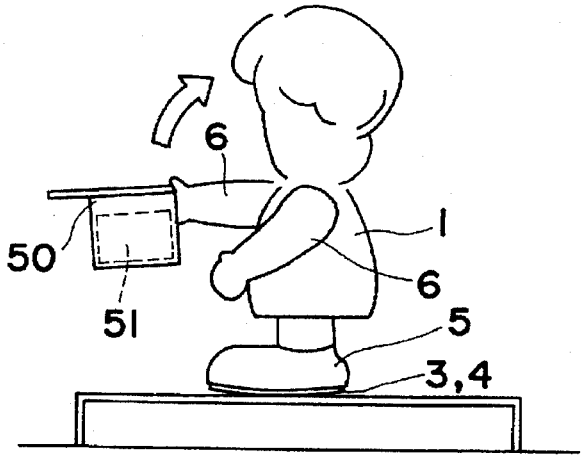
FIG. 9 is a further embodiment of the walking doll according to the present invention and is an explanatory view illustrating the state in which the doll performs a tap dance.
Figure 10A:
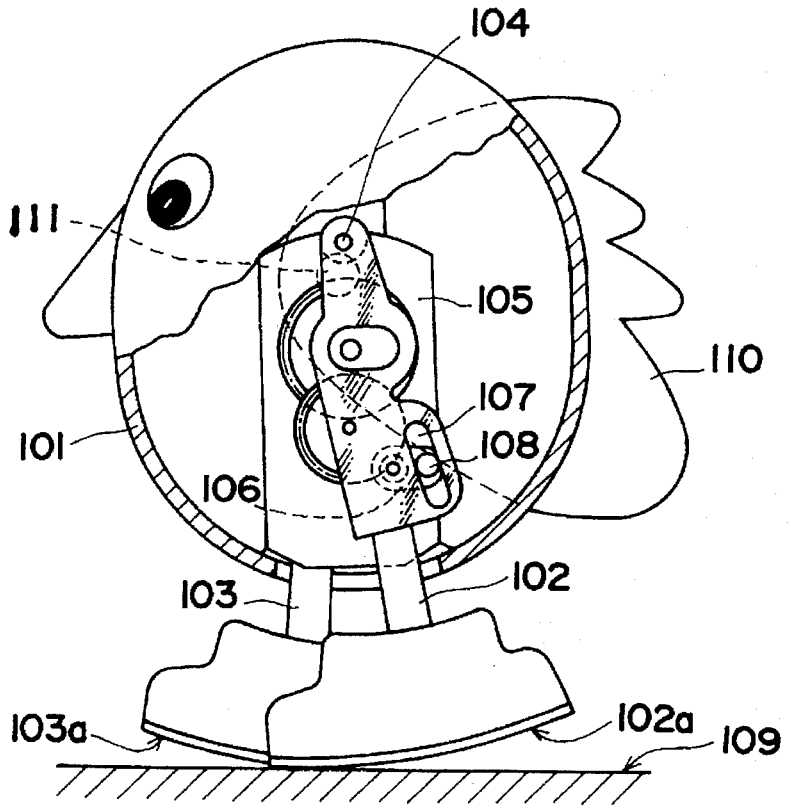
Fig. 10A (PRIOR ART)
FIG. 10A is a partial side sectional view of an example of a prior art walking doll.
Figure 10B:
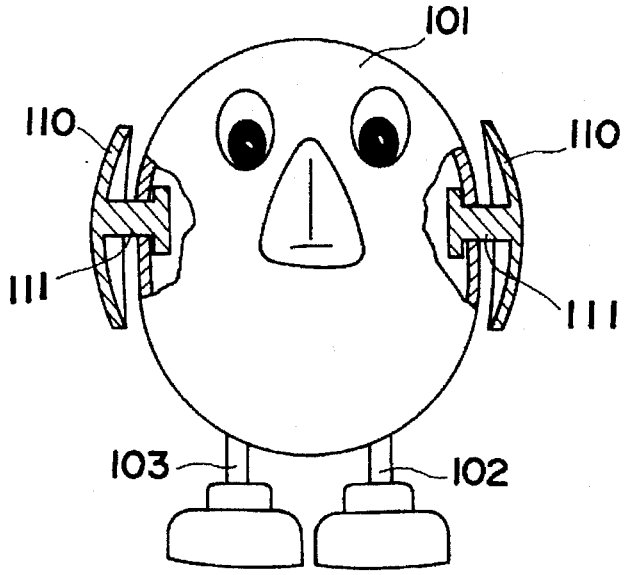
Fig. 10B (PRIOR ART)
FIG. 10B is a partially front sectional view of FIG. 10A, in which a wing portion is cross-sectionally shown.

Referring to FIG. 9, a silk hat 50 having a weight 51 therein is provided at the tip of the arm 6. When the silk hat 50 is held out or put on the head, it is possible to make such a state that the doll performs tap dancing in place.

In addition, although the arm 6 is connected to the body 1 by means of the first and second rotary shafts 9 and 11 in this embodiment, the present invention is not limited to this structure. For example, it may be possible to connect the body 1 to the arm 6 by using, e.g., a spherical joint to enable swivel of the arm 6 in the front/rear direction (the axial rotation in the horizontal direction) and in the right/left direction (the axial rotation in the front/rear direction). In such a case, the articulated structure is simplified. Further, the arm 6 itself may be formed by a material which is arbitrarily plastically deformable. For example, the arm 6 may consist of the chloroethylene generally used for the arms and legs of dolls which can be bent, and the alloy or resin being capable of restoring its original shape may be used for the core of the arm 6, in order to shift the center of gravity to the front/rear region or the side region of the body by deforming the arm 6 itself. In such a case, it is not necessary to attach the arm 6 to the body 1 in a rotatable manner, thereby simplifying the joint structure.

The description has been given mainly as to the case where the arm 6 which is the member for adjusting the position of gravitational center 34 is connected to the body 1 in the above embodiment, but the present invention is not restricted to this structure and the arm 6 may be freely attached or removed to or from the body 1 depending on the situation. In this case, it is further interesting to use fittings suitable for the character of the doll. For example, any other accessories such as a spear or a hatchet may be fitted to the arm 6, or these may also be pierced in the body 1.

Figure 13:
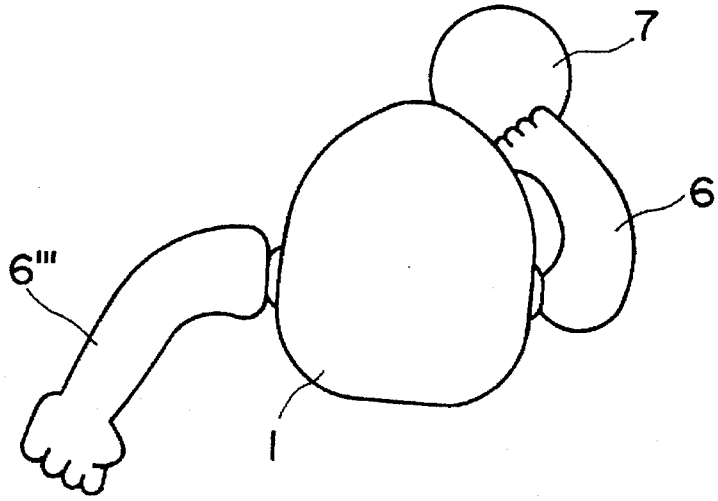
FIG. 13 is a top plan view of another embodiment of the invention with two movable members connected to the body.

Moreover, in this embodiment, the arm 6 and the ball 7 which are the member for adjusting the position of gravitational center are provided to only one side of the body 1, but these may be disposed to both sides of the body 1 as shown at 6 and 6''' in FIG. 13. In such a case, fine movement can be produced by moving these members respectively. For example, when both arms are simultaneously thrusted out frontward or backward, the moving speed is increased, and when the arms are thrusted out in the directions opposed to each other, the doll rapidly makes a smaller turn.

Further, the explanation is given mainly as to the embodiment in which the member for adjusting the position of gravitational center 34 does not move during the walking movement, but the present invention is not limited to this type and it may be possible to move the position of gravitational center by rotating the member 34 around one shaft during the walking movement. Although not illustrated, for example, the present invention may have such a structure that a part of the rotary shaft of the gear unit 2 projects from the body 1 and the first rotary shaft 9 of the arm 6 is connected to this part in such a manner that the arm rotates around the first rotary shaft 9 as the rotary shaft 9 rotates. In such a case, the walking direction varies in a more complicated fashion.

Figure 6:
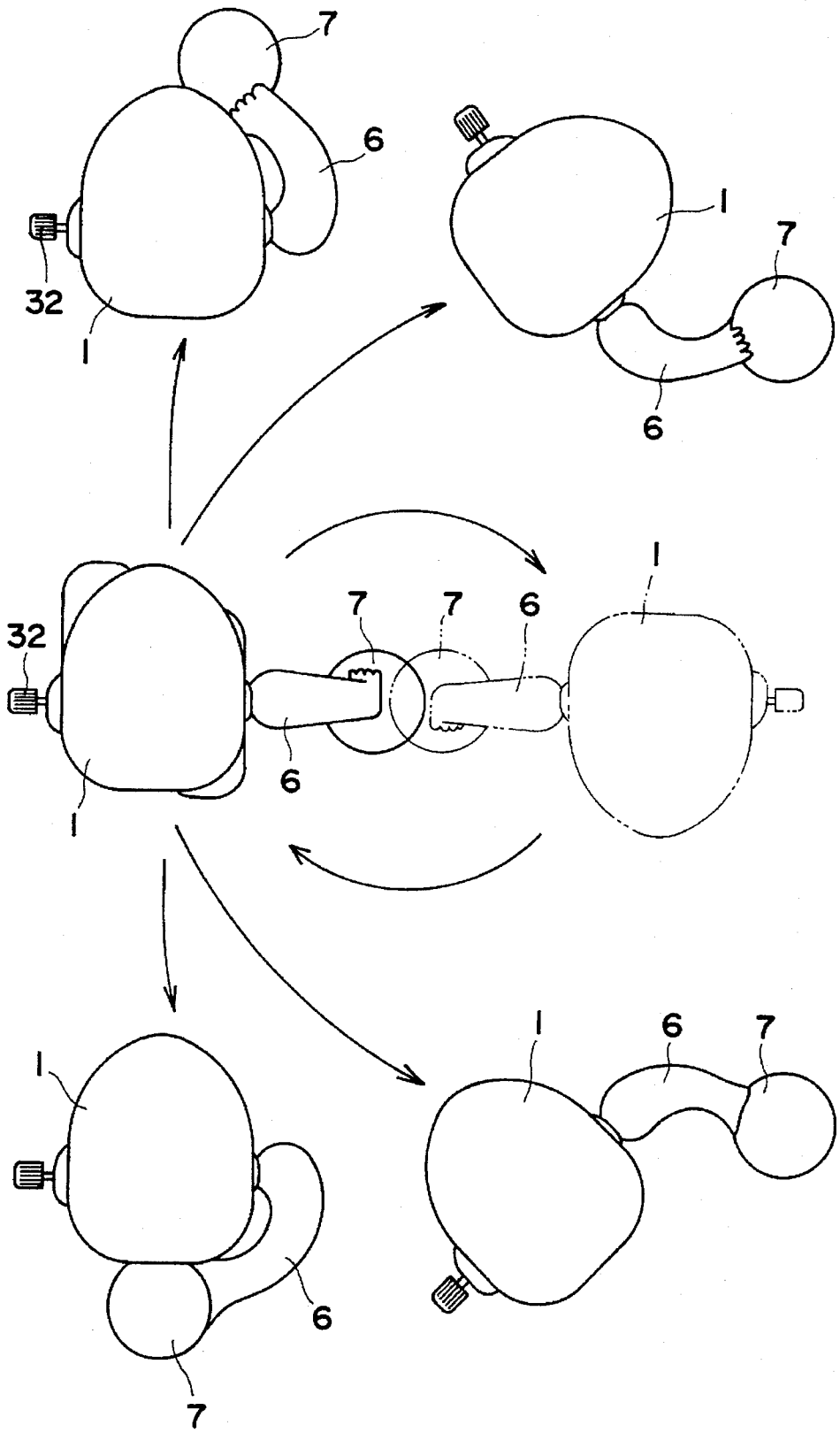
FIG. 6 is a plan view for explaining the movement of the doll shown in FIG. 1.

As is apparent from the above description, according to the present invention, in a walking doll shuffling its feet by forcibly oscillating a pair of feet, there is provided a member for adjusting the position of gravitational center which is rotated or deformed in two orthogonal planes, that is, on a plane parallel with the oscillating direction and a plane orthogonal to the former plane and which is capable of three-dimensionally shifting the position of gravitational center frontward and backward or to a side region of the doll, and hence the doll shuffles its feet as it walks from the position of the feet being in contact with the floor toward the position of the center of gravity without lifting the feet from the floor when the feet are alternately oscillated by force. For example, as shown in FIG. 6, the doll executes complicated movements such as stamping its feet or making a small turn in place, going straight toward the center of gravity, or making a big turn to go forward or backward while shuffling.

Further, in some versions of the present invention, since the movement region of the member for adjusting the position of gravitational center can be freely set within a hemisphere including the front/rear and side regions, the walking direction or movement is enlarged and the interest of the doll's movement can be increased. According to the present invention, since the center of gravity can be shifted by deforming the member for adjusting the position of gravitational center itself, the attachment structure of the member for adjusting the position of gravitational center relative to the body can be considerably simplified.

Further, when a weight is provided to the tip of the member for adjusting the position of gravitational center, the vector toward the center of gravity becomes large, thereby increasing the walking speed of the doll and enabling secure progress toward an intended direction.

In addition, when the L-shaped member for adjusting the position of gravitational center is used, the center of gravity can be shifted to a position closer to the center plane of the body, even when the end portion of the member for adjusting the position of gravitational center is placed in the front or rear region of the body, enabling straightforward movement and widely set walking direction.

Moreover, when the member for adjusting the position of gravitational center can be attached or removed to or from the body, the interest or fittings suitable for the character of the doll, is increased.

Further, according to the present invention, when weights are provided to the tips of the feet, i.e., in the vicinity of portions of the feet which are brought into contact with the floor, the center of gravity is lowered, realizing stable walking movement.

In addition, since the walking doll according to the invention can stand on its head and rotate around the head like a break dancer, this increases the interest of the doll.

Furthermore, the walking doll of the invention can be attended with another movement like kicking a ball.

Moreover, the walking doll according to another feature of the invention can move like a tap dancer, by holding out the silk hat or putting the silk hat on the head.

Figure 11:
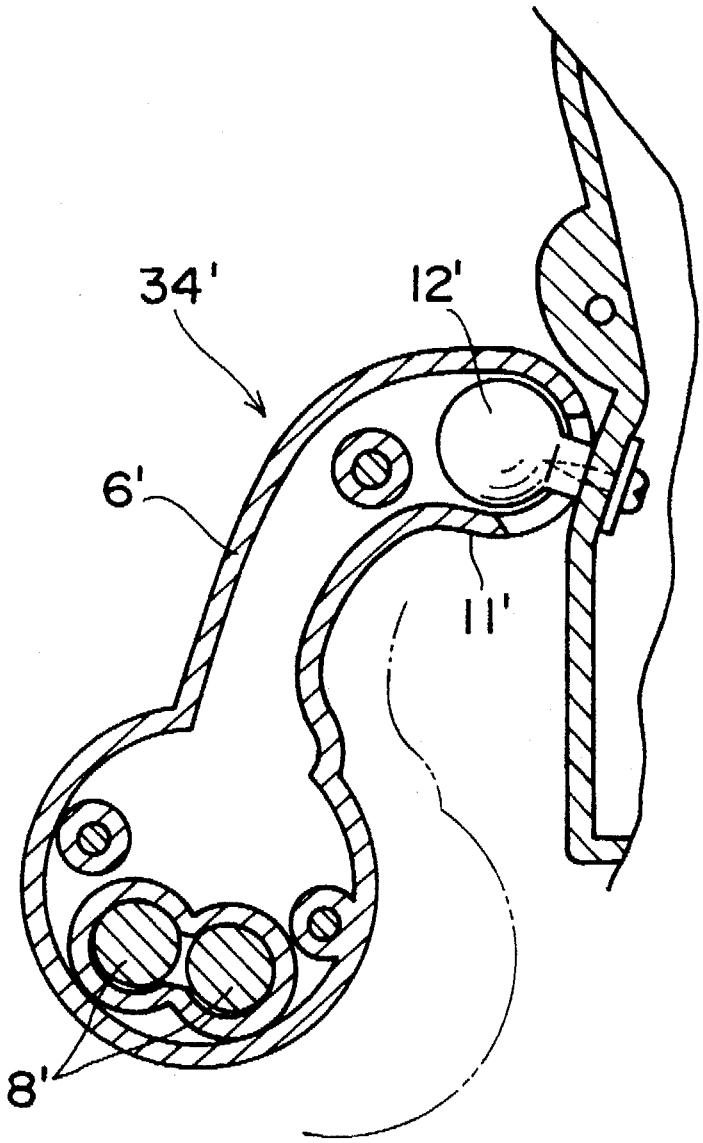
FIG. 11 is a partial sectional view showing the embodiment of the invention using a ball joint for connecting a member for the body.
Figure 12:
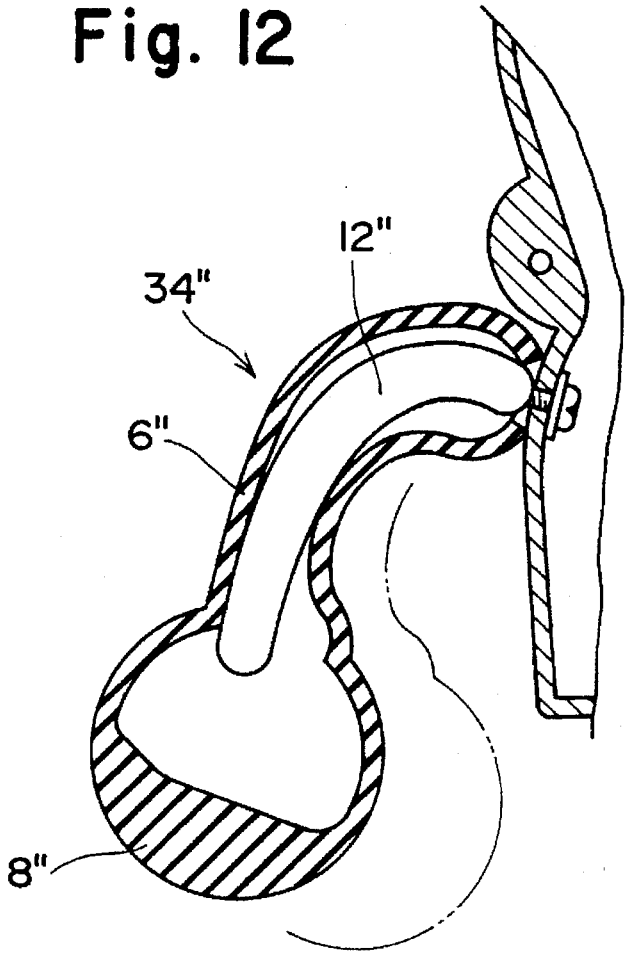
FIG. 12 is a view similar to FIG. 11 of another embodiment of the invention with a plastically deformable member connected to the body.

In FIG. 11, another embodiment of member 34' is connected to the body with a ball and socket joint 11' and 12', connecting the L-shaped arm 6' with weights 8' to the body. The embodiment of FIG. 12 shows a plastically deformable member 34", made with a plastically deformable arm 6', having an enlarged weighted end 8', and a plastically deformable inner member 12', fixed to the body and bendable into a shape which is retained for bending the arm 6'.

Figure 14A:
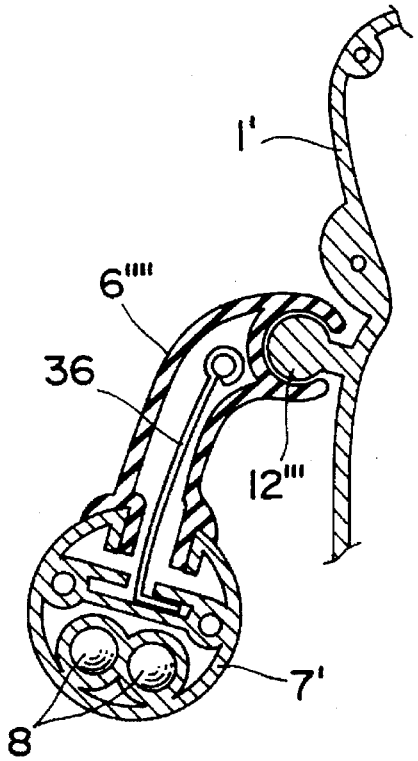
FIG. 14A.
Figure 14B:
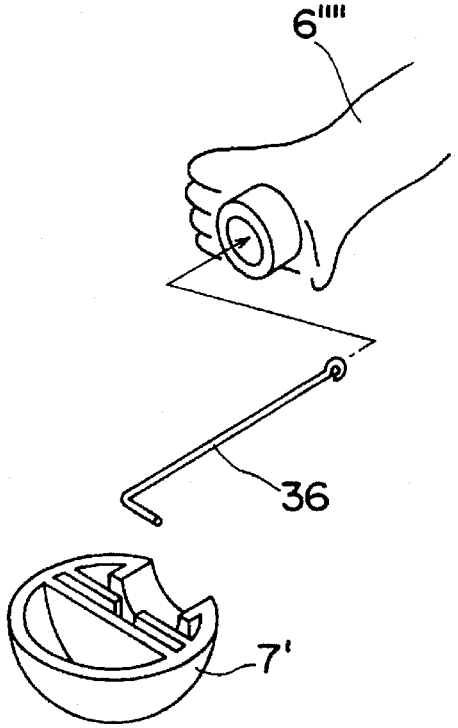
FIG. 14B are respective sectional and exploded views illustrating a further embodiment of the invention.

FIGS. 14A and 14B show a further embodiment of the member 34 for adjusting the position of gravitational center. In this embodiment, the member 34 is constituted by: an arm 6"" having a hollow shape obtained by blow-molding a plastically deformable material such as polyvinyl chloride (PVC); an additional element or ball 7' containing weights and is molded separately from the arm 6""; a bendable wire 36 which is set between the ball 7' and the arm 6"" and made of a plastically deformable material, and so provided as to stop the deformation of the arm 6"" at an arbitrary position. The arm 6"" is rotatably engaged with a spherical projection 12"" integrally molded with a body 1'. Ball 7' can be plugged onto the end of arm 6"" and held by known means and also by a bend in wire 36. A loop at the opposite end of wire 36 holds the wire inside arm 6"".

Figure 15A:
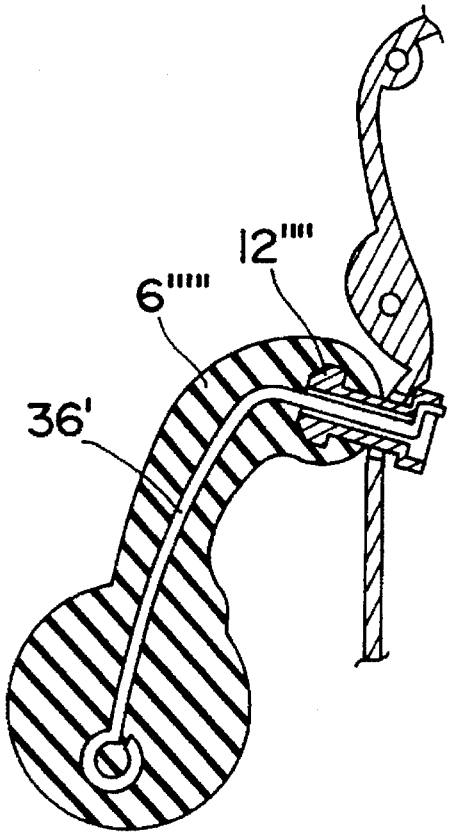
FIG. 15A.
Figure 15B:
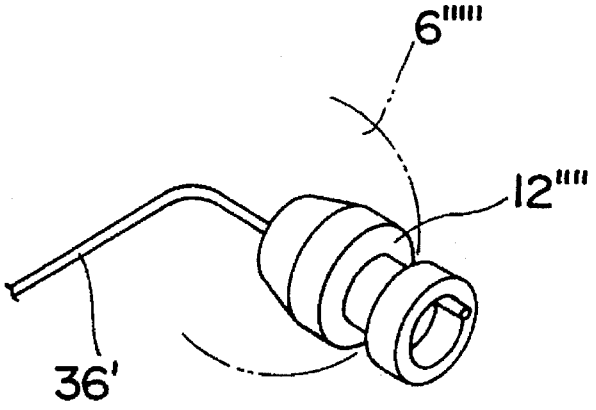
FIG. 15B are respective sectional and perspective views showing a still further embodiment of the invention.

The member 34 shown in FIGS. 15A and 15B is obtained by integrally molding an arm 6""" and a ball 7" with a plastically deformable material such as PVC and insert-molding a wire 36' made of a plastically deformable material and a sleeve 12"" allowing the rotation of the arm 6"". The free deformation of the arm 6""" is enabled and its deformed state can be maintained similar to the embodiment shown in FIGS. 14A and 14B.

Figure 2:
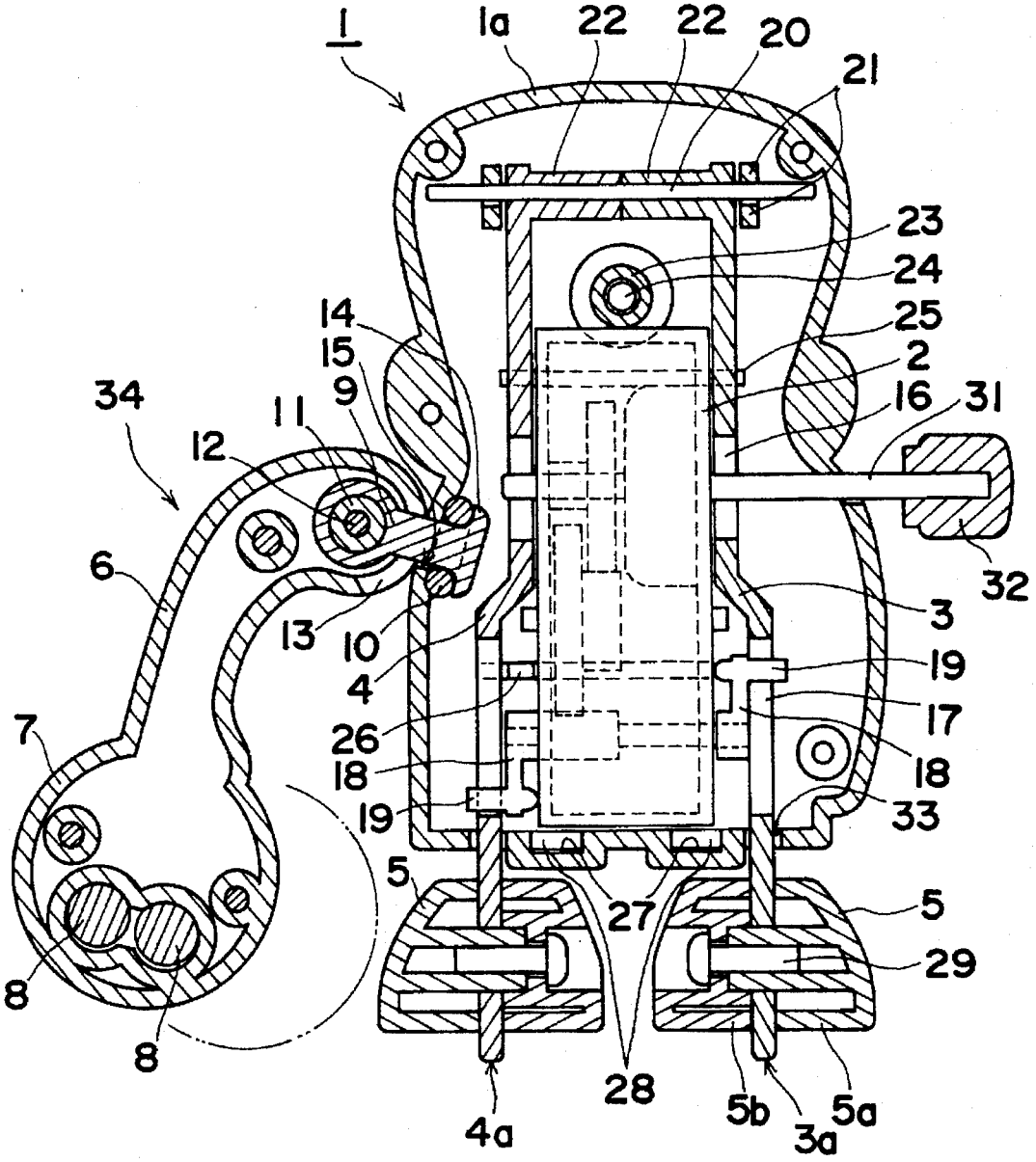
FIG. 2 is a cross-sectional view taken perpendicularly to FIG. 1.
Figure 3:
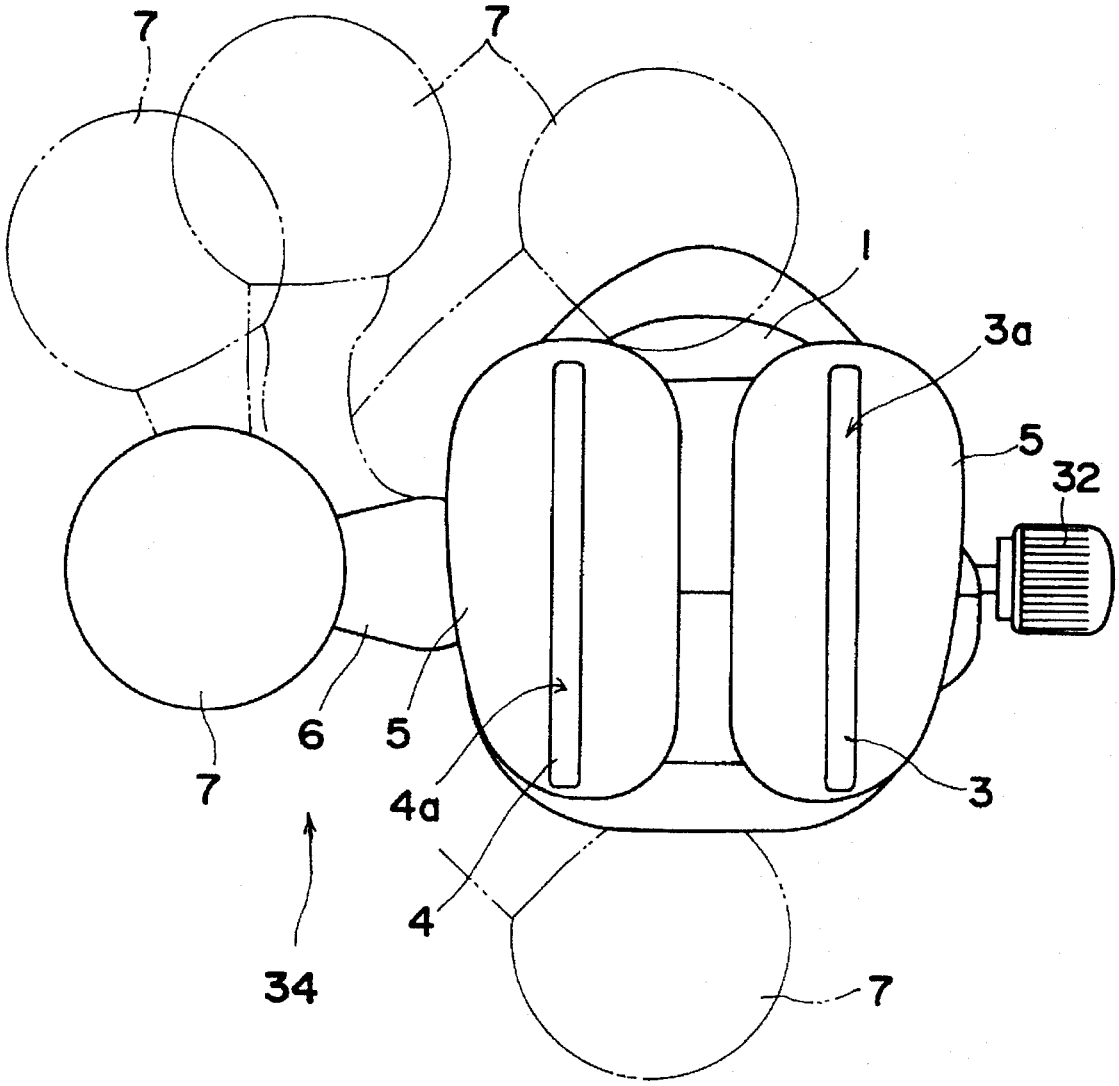
FIG. 3 is a bottom plan view of the doll shown in FIG. 1.
Figure 4:
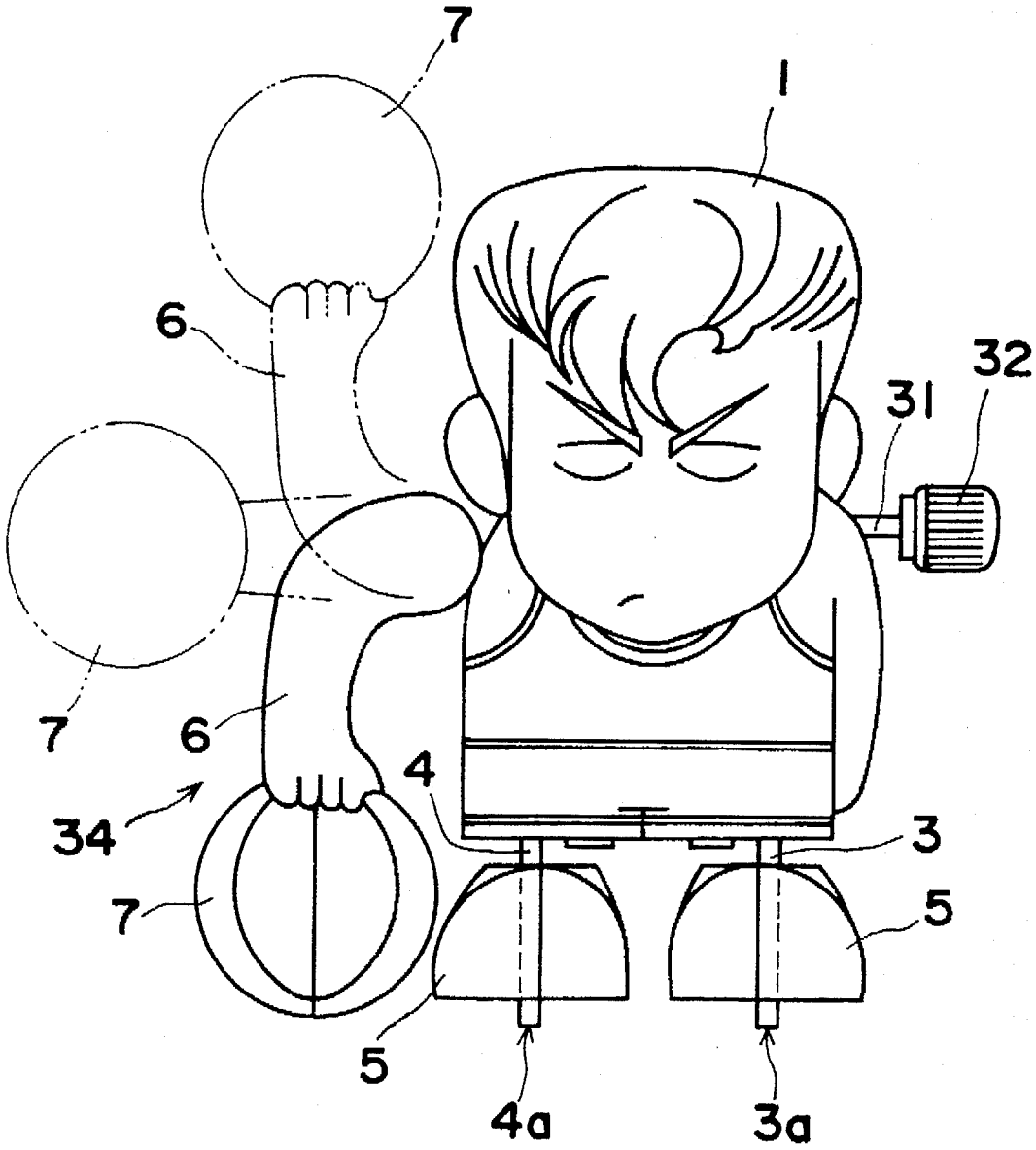
FIG. 4 is a front elevational view showing the appearance of the doll illustrated in FIG. 1.
Figure 5:
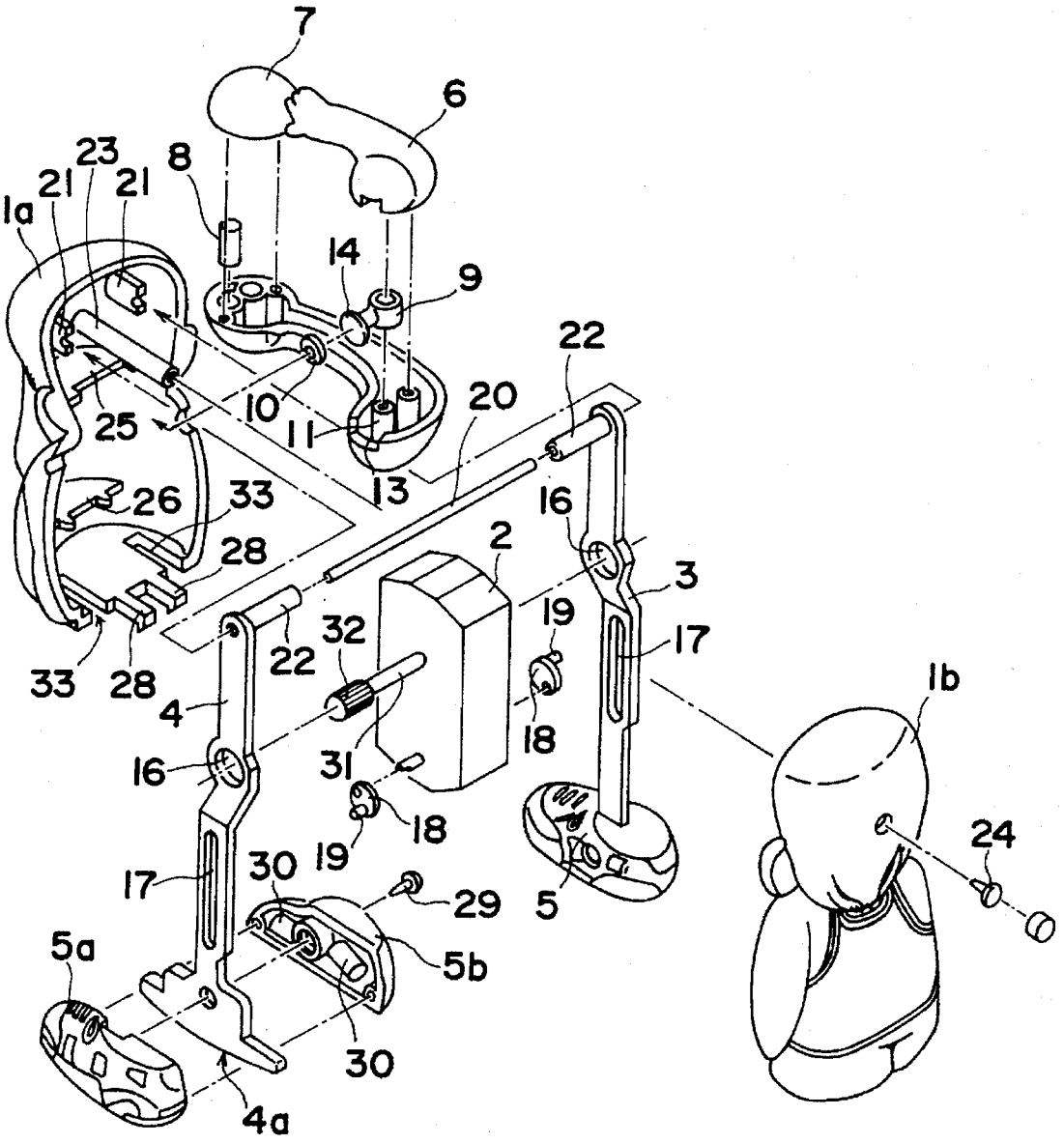
FIG. 5 is an exploded perspective view of the doll shown in FIG. 1.
Figure 16A:
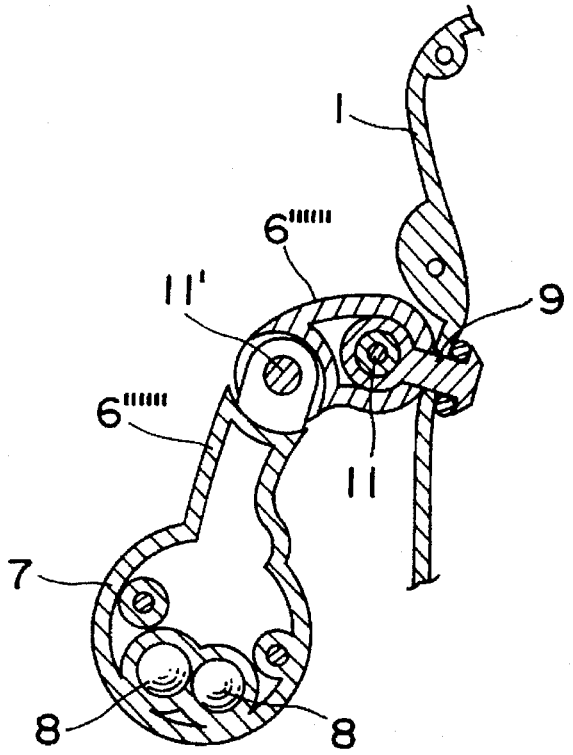
FIG. 16A and FIG. 16B are respective sectional and exploded views showing a still further embodiment of the invention.
Figure 16B:
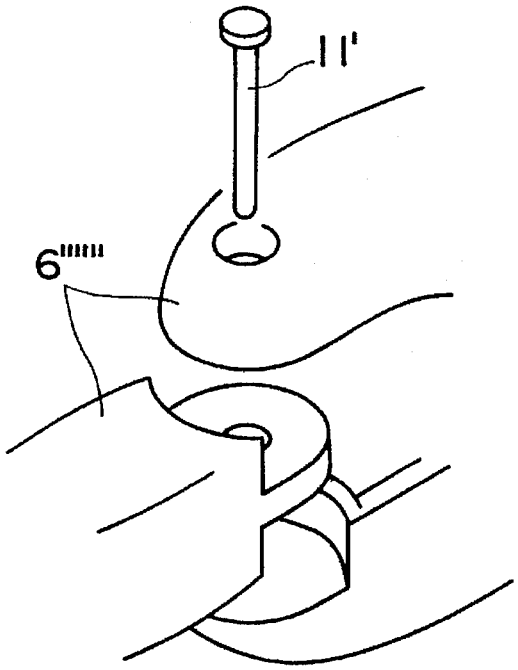

Referring to FIGS. 16A and 16B, the arm shown in FIG. 2 is formed by two split parts and these parts are connected by a joint 37 composed of a pin joint so that the arm 6"" can be deformed around a second rotary shaft 11 and a third shaft 11' which is parallel with the shaft 11. In this case, the rotation of the arm 6"" around the three shafts 9, 11 and 11' enables the complicated adjustment of the position of gravitational center.

What is claimed is:

1. A walking doll comprising:

a body;

a power crank mechanism in the body;

a pair of feet having the same length as each other, the feet each having upper ends extending into the body and connected to and driven by the power crank mechanism, the feet being driven in an oscillating direction in a forward and rearward manner with respect to the body, for alternately oscillating the feet back and forth by force, the feet having lower ends extending outside the body on which the body stands erect on a floor, the lower ends being fixed to and only movable with the upper ends of the feet, the lower ends of the feet each having a narrow surface in contact with the floor, each narrow surface having a curvature in said oscillating direction and being narrow transverse to said oscillating direction, both of the feet being constantly in contact with the floor when the doll is walking; and a member for adjusting a position of a gravitational center of the walking doll, the member being movably connected to the body and free of the power crank mechanism for movement, in a first plane which is parallel to the oscillating direction and also for movement in another plane which is orthogonal to the first plane, so that the member is movable for a three-dimensional shifting of position of the gravitational center, forwardly, backwardly and outwardly with respect to the body.

2. A walking doll as set forth in claim 1, wherein the member for adjusting the position of the gravitational center is connected to the body by a first rotary shaft substantially orthogonal to the oscillating direction of the feet and by a second rotary shaft orthogonal to said first rotary shaft, so as to allow movement of the member back and forth and transversely of the body.

3. A walking doll as set forth in claim 1, wherein the member for adjusting the position of the gravitational center is connected to the body through a spherical joint so as to be freely movable back and forth and transversely of the body.

4. A walking doll as set forth in claim 1, wherein the member for adjusting the position of the gravitational center is made of a material which is plastically deformable so that the member can be bent to move the gravitational center back and forth and transversely of the body, by deforming the member.

5. A walking doll as set forth in claim 1, wherein the member for adjusting the position of the gravitational center has an end, and a weight at the end of the member.

6. A walking doll as set forth in claim 1, wherein the member for adjusting the position of the gravitational center is L-shaped.

7. A walking doll as set forth in claim 1, wherein the member for adjusting the position of the gravitational center is connected to a side of the body.

8. A walking doll as set forth in claim 1, wherein the member for adjusting the position of the gravitational center is removable from the body.

9. A walking doll as set forth in claim 1, including a weight in the lower end of each of the feet.

10. A walking doll as set forth in claim 1, wherein the body is shaped to have a flattened parietal portion so that the doll can stand on the parietal portion of the body and on an outer end of the member for adjusting the position of the gravitational center.

11. A walking doll as set forth in claim 1, including means at a tip portion of each of said feet for supporting a ball so that the ball moves back and forth with oscillating movement of the feet.

12. A walking doll as set forth in claim 1, including silk hat means for simulating a silk hat, at an outer end tip of said member for adjusting the position of the gravitational center, with a weight in the hat means.

13. A walking doll as set forth in claim 2, including a vertical plate having a lower edge forming the curvature in said oscillating direction and which is in contact with the floor, connected to the lower ends of each of the feet so that the body can stand on the curved edges of the plates.

14. A walking doll as set forth in claim 5, including a vertical plate having a lower edge forming the curvature in said oscillating direction and which is in contact with the floor, connected to the lower ends of each of the feet so that the body can stand on the curved edges of the plates.

15. A walking doll as set forth in claim 5, wherein the weight comprises an additional element connected to an end of the member for containing the weight.

16. A walking doll according to claim 15, wherein the member comprises an outer plastically deformable arm and an inner bendable wire having opposite ends, one end of the bendable wire being connected to the arm and the other end of the wire being connected to the element for helping to hold the element to the arm.

17. A walking doll according to claim 5, wherein the member comprises an arm having one end pivotally mounted to the body and an opposite end which is enlarged to form a weight, the arm being made of plastically deformable material, and a bendable wire in the arm.

18. A walking doll according to claim 1, wherein the member comprises an arm having a first portion pivotally connected to the body, the first portion having an outer end, and a second portion with an inner end connected to the outer end of the first portion.

19. A walking doll according to claim 18, wherein the second portion includes an outer enlarged end forming a weight.

20. A walking doll comprising:

a body;

a power crank mechanism in the body;

a pair of feet having the same length as each other, connected to and driven by the power crank mechanism, the feet being driven in an oscillating direction in a front and rear manner with respect to the body, for alternately oscillating the feet back and forth by force, the feet having lower ends extending outside the body on which the body stands erect on a floor, the lower ends of the feet each having a surface in contact with the floor, each said surface having a curvature in said oscillating direction, the feet being constantly in contact with the floor;

a member for adjusting a position of a gravitational center of the walking doll, the member being movably connected to the body for movement in a first plane which is parallel to the oscillating direction and also for movement in another plane which is orthogonal to the first plane, so that the member is movable for a three-dimensional shifting of position of the gravitational center, forwardly, backwardly and outwardly with respect to the body; and a vertical plate having a lower edge forming the curvature in said oscillating direction and which is in contact with the floor, connected to the lower edges of each of the feet so that the body can stand on the lower edges of the plates.

* * * * *